US006002371A

United States Patent [19]

Mittler et al.

[11] Patent Number: 6,002,371

[45] Date of Patent: Dec. 14, 1999

[54] DIE-CUT ANTENNA FOR CORDLESS TELEPHONE RADIO TRANSCEIVER

[75] Inventors: Jon P. Mittler, Cordova, Tenn.; Terry L. Fry, Davidsonville, Md.

[73] Assignee: Brother International Corporation, Somerset, N.J.

[21] Appl. No.: 08/749,206

[22] Filed: Nov. 14, 1996

[51] Int. Cl.[6] ..... H01Q 1/24

[52] U.S. Cl. ..... 343/702; 343/700 MS; 343/795

[58] Field of Search ..... 343/700 MS, 702, 343/795, 872, 901, 767, 873; H01Q 1/24

[56] References Cited

U.S. PATENT DOCUMENTS

| | | | |
|---|---|---|---|
| 3,049,711 | 8/1962 | Hooper . | |
| 3,623,162 | 11/1971 | Whitty | 343/767 |
| 3,689,929 | 9/1972 | Moody . | |
| 4,123,756 | 10/1978 | Nagata et al. . | |
| 4,435,713 | 3/1984 | Gasparaitis et al. . | |
| 4,849,765 | 7/1989 | Marko . | |
| 4,894,663 | 1/1990 | Urbish et al. . | |
| 4,920,353 | 4/1990 | Mori et al. | 343/702 |
| 5,014,346 | 5/1991 | Phillips et al. | 343/702 |
| 5,079,559 | 1/1992 | Umetsu et al. . | |
| 5,184,143 | 2/1993 | Marko . | |
| 5,365,246 | 11/1994 | Rasinger et al. | 343/702 |
| 5,392,056 | 2/1995 | DeTeso . | |
| 5,402,135 | 3/1995 | Demarre et al. | 343/715 |
| 5,451,965 | 9/1995 | Matsumoto | 343/702 |
| 5,495,260 | 2/1996 | Couture . | |
| 5,524,284 | 6/1996 | Marcou et al. . | |
| 5,646,635 | 7/1997 | Cockson et al. | 343/702 |
| 5,821,903 | 10/1998 | Williams | 343/702 |

OTHER PUBLICATIONS

IBM Technical Disclosure Bulletin vol. 36 No. 09A Sep. 1993, Antenna on Flexible Carrier pp. 433 and 434.

*Primary Examiner*—Don Wong
*Assistant Examiner*—Tho Phan
*Attorney, Agent, or Firm*—Oliff & Berridgs, PLC

[57] ABSTRACT

An antenna assembly is formed as a thin, unitary element with parallel leads laminated to an insulator. The unitary antenna element includes an integral attachment portion for connection to a printed circuit board. The antenna assembly is usable in electronic devices, such as a cordless telephone radio transceiver. A molded cover, which is directly attached to the electronic device rather than the antenna assembly, is provided to encase and protect the antenna.

17 Claims, 9 Drawing Sheets

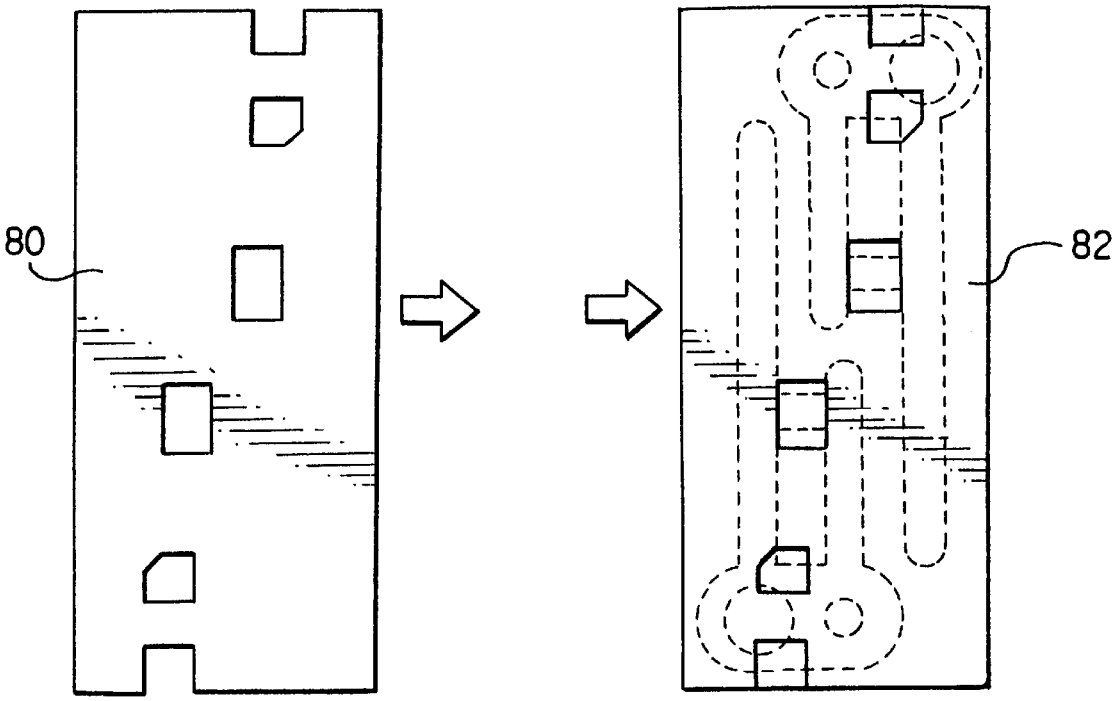
FIG. 9A
FIG. 9B
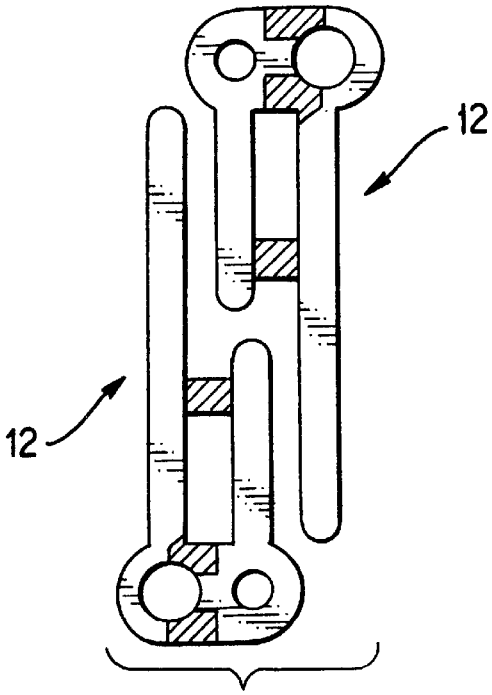
FIG. 9C

DIE-CUT ANTENNA FOR CORDLESS TELEPHONE RADIO TRANSCEIVER

BACKGROUND OF THE INVENTION

1. Field of the Invention

The invention is directed to an antenna assembly for use in an electronic apparatus. More particularly, this invention is directed to a thin antenna for use with a portable electronic apparatus, such as a cordless telephone, and its method of manufacture.

2. Description of Related Art

Antenna elements in cordless telephones are typically either a heavy wire coiled like a spring or a small wire that is wrapped around a separate wire core. Other known antenna assemblies can be constructed as a braided cable or a center conductor of a coaxial cable.

A protective cover is generally provided over the antenna assembly. The cover is typically made of plastic and either molded over the antenna lead or attached to the antenna lead by separate fasteners, crimping or gluing. However, such covers do not adequately protect the antenna lead since these covers are directly attached to the antenna. For example, when a force is applied to the prior art covers of an antenna assembly, that force will be directly transmitted to the antenna assembly and/or internal circuitry of an electronic apparatus.

The prior art antenna assemblies discussed above have further drawbacks including additional required parts that make assembly more complicated and expensive. For example, conventional antenna assemblies cannot be connected directly to circuitry of a printed circuit board of an associated electronic apparatus. Conventional antenna assemblies require additional connection parts and/or supplemental connection parts, such as stamped or die cast brackets, wires and supports. These must be soldered, screwed or otherwise connected to a printed circuit board of the electronic apparatus. Further, they usually require at least one additional connection part to attach them to an actual antenna lead. Of course, this increases the cost of the antenna assembly, requires more manufacturing steps to assemble the antenna to the electronic device and complicates the overall antenna assembly. Further, the additional parts and connections introduce additional failure locations in the antenna assembly and associated electronic apparatus.

Another drawback in conventional antenna assemblies is that a separate ground lead must be provided when the physical length of the antenna is longer than its electrical length. Attempts to overcome this and other disadvantages have included covering a part of the antenna with a braided sheath, such as the outer conductor of a coaxial cable. However, supplemental parts are then required to connect this ground to the printed circuit board. Further, an insulator is required to separate the ground from the driven lead of the antenna assembly. This, of course, also increases the cost of the antenna assembly, adds steps to the manufacturing process and provides additional failure points in the antenna assembly.

A further drawback in conventional antenna assemblies is that these assemblies and covers rely on the antenna lead itself for mechanical strength. Since the antenna cover is attached to the antenna lead, any force, stress or strain applied to the cover is transferred directly to the antenna lead. In turn, the force is transferred directly to the printed circuit board of the associated electrical apparatus. This, of course, leads to breakage of the antenna leads and printed circuit board of the associated electrical apparatus and/or deterioration of the operation of the electrical apparatus.

SUMMARY OF THE INVENTION

The invention has been developed to overcome the above and other disadvantages associated with conventional antenna assemblies.

An object of the embodiments of this invention is to provide an antenna assembly usable with a portable electronic device, such as a cordless telephone.

Another object of the embodiments of this invention is to provide an antenna assembly that provides a simple configuration to provide a reliable electrical connection that is easy to manufacture and install.

A further object of the embodiments of this invention is to provide an inexpensive antenna assembly that does not require complicated manufacture or excess parts.

An additional object of the embodiments of this invention is to provide a cover that protects the antenna from damage.

According to this invention, a thin one-piece antenna assembly for an electrical apparatus comprises a pair of parallel leads laminated onto an insulator substrate. The substrate with the leads thereon is then simply and directly secured to a printed circuit board in an electronic device.

Also, according to this invention, a cover in the form of a sheath is assembled around the antenna leads and secured to the electronic device, without direct connection to the antennas leads.

The method of manufacturing an antenna assembly according to the embodiments of this invention includes laminating a conductor onto a substrate and then die cutting the laminated substrate. The assembly is then folded into the proper configuration with a pair of parallel leads disposed adjacent to each other and secured with a fastener to a printed circuit board in the electronic device.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The invention will be described in detail with reference to the following drawings, in which like reference numerals refer to like elements, wherein:

FIGS. 9A–9C illustrate the steps of a die cutting technique usable to manufacture an antenna assembly according to this invention.

DETAILED DESCRIPTION OF PREFERRED EMBODIMENTS

The antenna assembly according to the preferred embodiments of the invention is described with reference to the attached figures. For purposes of illustration, the invention is shown embodied as an antenna assembly for a cordless telephone radio transceiver. The antenna assembly is shown as used on a cordless handset but may be used on the base as well. Additionally, this antenna may be used on any electronic device, particularly a portable device in which a small size is preferred, such as a pager, a radio, or a remote controlled device.

Figure 1A:
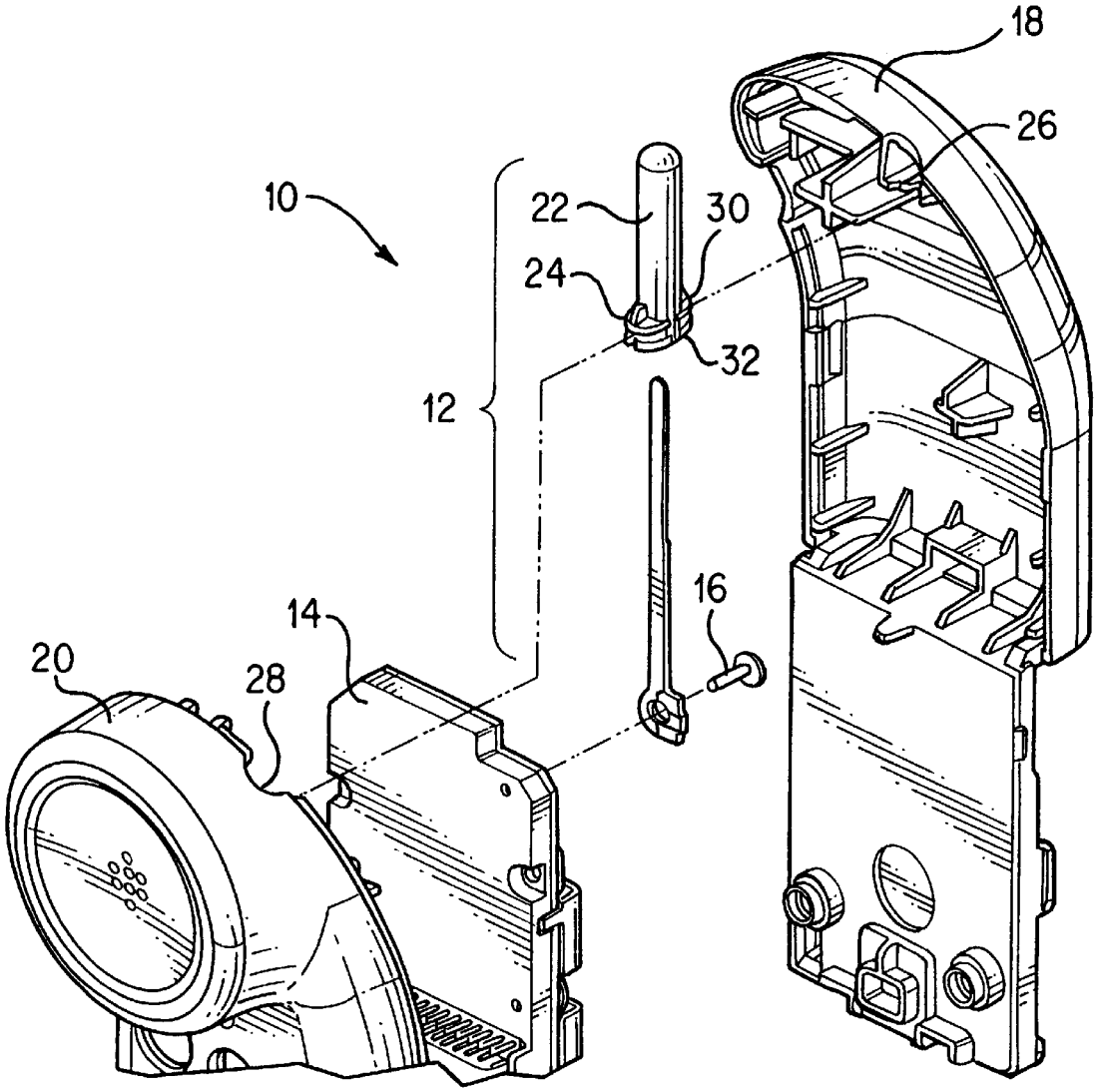
FIG. 1A is an exploded partial perspective view of the electronic device with the antenna assembly and antenna cover of this invention.
Figure 1B:
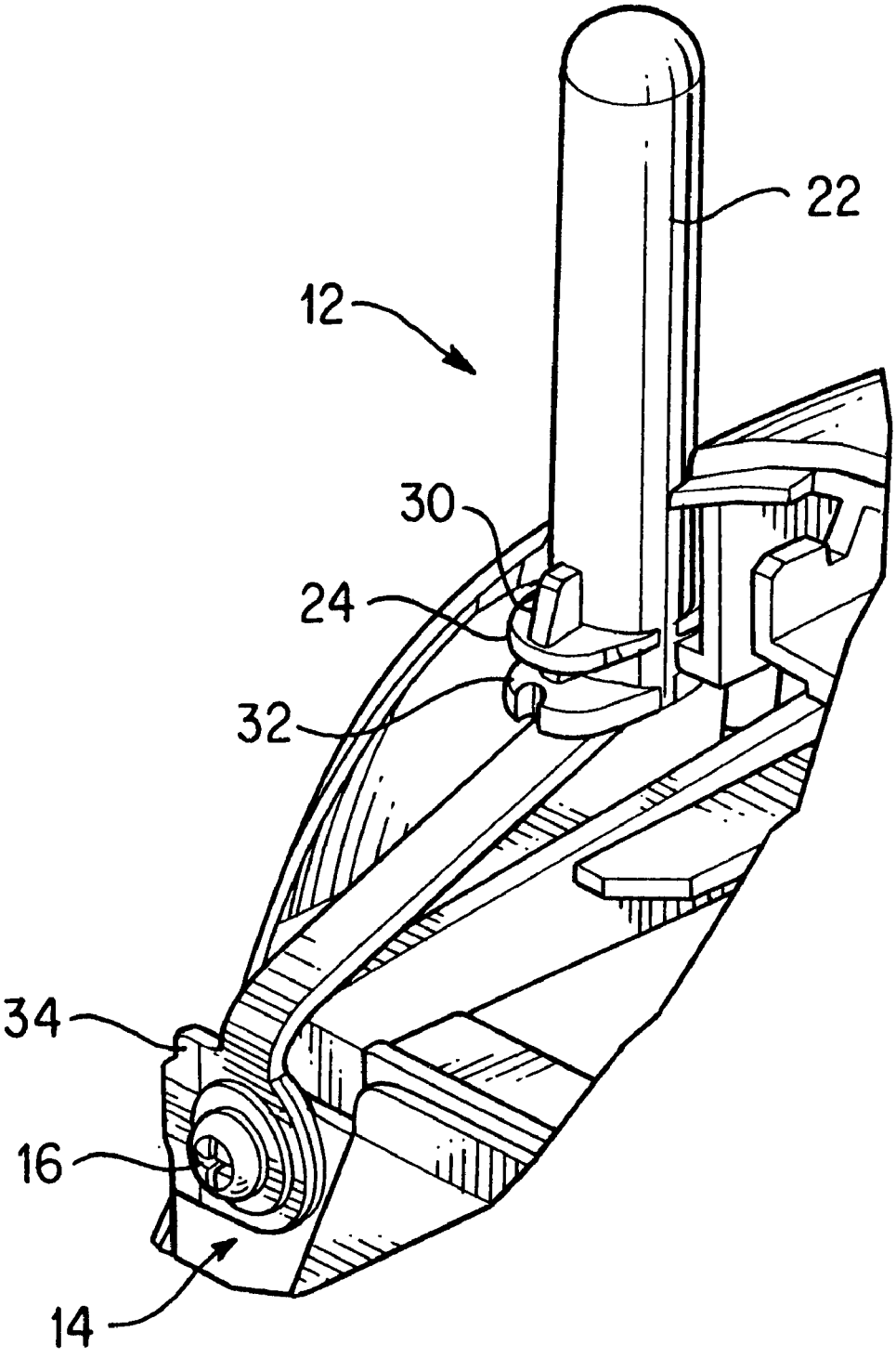
FIG. 1B is a partial perspective view of the electronic device with the antenna assembly assembled in an antenna cover according to this invention.

Referring to the figures, FIGS. 1A and 1B show an electronic device 10, such as a cordless telephone, with an antenna assembly 12 attached thereto. Antenna assembly 12 is directly coupled to a printed circuit board 14, which in this preferred embodiment is a radio transceiver printed circuit board with a shield. However, it will be appreciated that this antenna assembly can be secured to any printed circuit board. Antenna assembly 12 is directly secured to printed circuit board 14 by a fastener, shown as a self-tapping screw 16 (screw 16 actually screws directly into the shield). However, any suitable fastener can be employed including but not limited to a brad or a rivet.

Printed circuit board 14 is encased in a housing having a first part 18 and a second part 20 that connect to form the outer shell of the electronic device 10. Preferably, the first part 18 and the second part 20 of the housing are made of a lightweight, durable material such as a rigid plastic.

A cover 22 is disposed over at least a portion of antenna assembly 12 to protect antenna assembly 12 from damage and environmental influences. Cover 22 is a tubular sheath that fits loosely over antenna assembly 12 and does not directly attach to antenna assembly 12. Cover 22 is preferably made of a resilient molded material. Examples of suitable material include Santoprene 101-87 from Advanced Elastomer Systems or Kraton G7820 from Shell Chemical. One method of forming cover 22 is injection molding, which will result in a one-piece sheath. Cover 22 is formed with an integral grommet 24 for attachment to the first part 18 and second part 20 of housing by being clamped between cutouts 26 and 28, respectively. Grommet 24 is formed with a pair of shoulders 30 and 32 that are designed to abut each side of cutouts 26 and 28 to stabilize the connection. Of course, the housing may be formed with a single aperture, rather than first and second parts with cutouts therein, into which grommet 24 may be snap fit.

As mentioned above, cover 22 is only attached to the housing, not antenna assembly 12. Therefore, any stress, strain or force experienced by cover 22 will be transferred directly to the housing and will not influence antenna assembly 12.

Figure 2A:
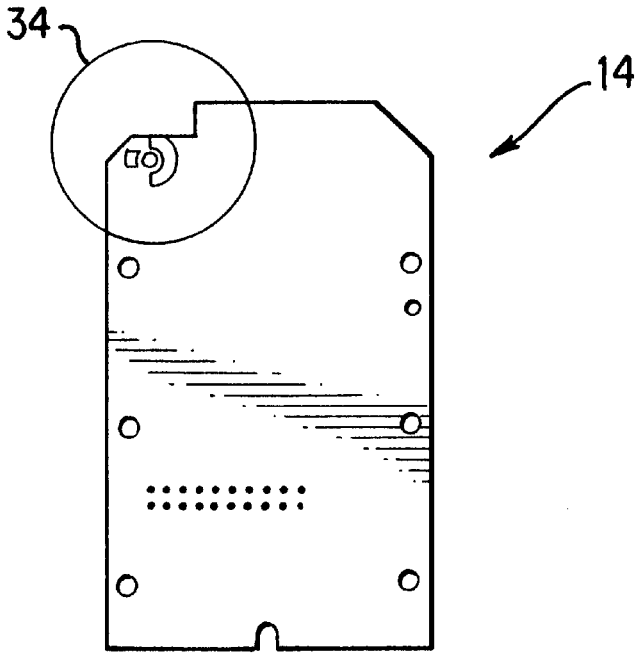
FIG. 2A is a top plan view of a printed circuit board used in this invention with the antenna assembly.
Figure 2B:
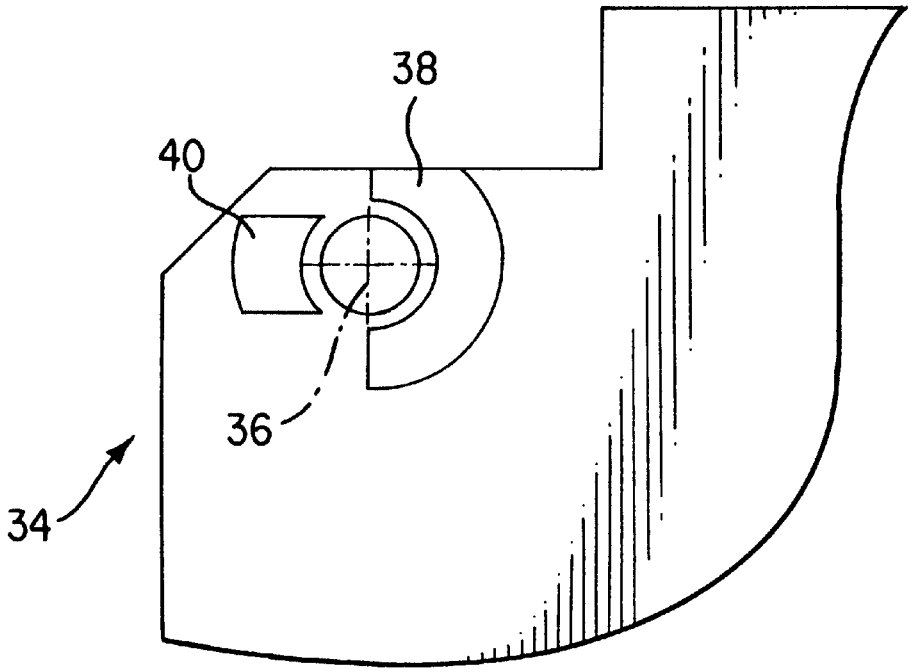
FIG. 2B is an enlarged view of a portion of FIG. 2A showing the attachment point on the printed circuit board for the antenna assembly.

Printed circuit board 14 is shown in detail in FIGS. 2A and 2B. Printed circuit board 14 has an antenna assembly attachment point 34 disposed in one corner thereof. Attachment point 34 may be disposed at any location of the printed circuit board depending upon its intended use and the particular electronic device in which it is used. FIG. 2B shows an enlarged view of attachment point 34, which includes an aperture 36 for securement to a fastener, such as screw 16, to directly connect antenna assembly 12 to printed circuit board 14. Disposed on one side of aperture 36 is a hot lead 38, and disposed on the other side of aperture 36 is a ground lead 40. Hot lead 38 and ground lead 40 are arranged to electrically connect to the leads on antenna assembly 12, which are discussed in detail below. Any suitable configuration of the leads on printed circuit board 14 would be acceptable as long as the leads complemented the arrangement of leads on the antenna assembly in order to provide a secure electrical connection.

Figure 3:
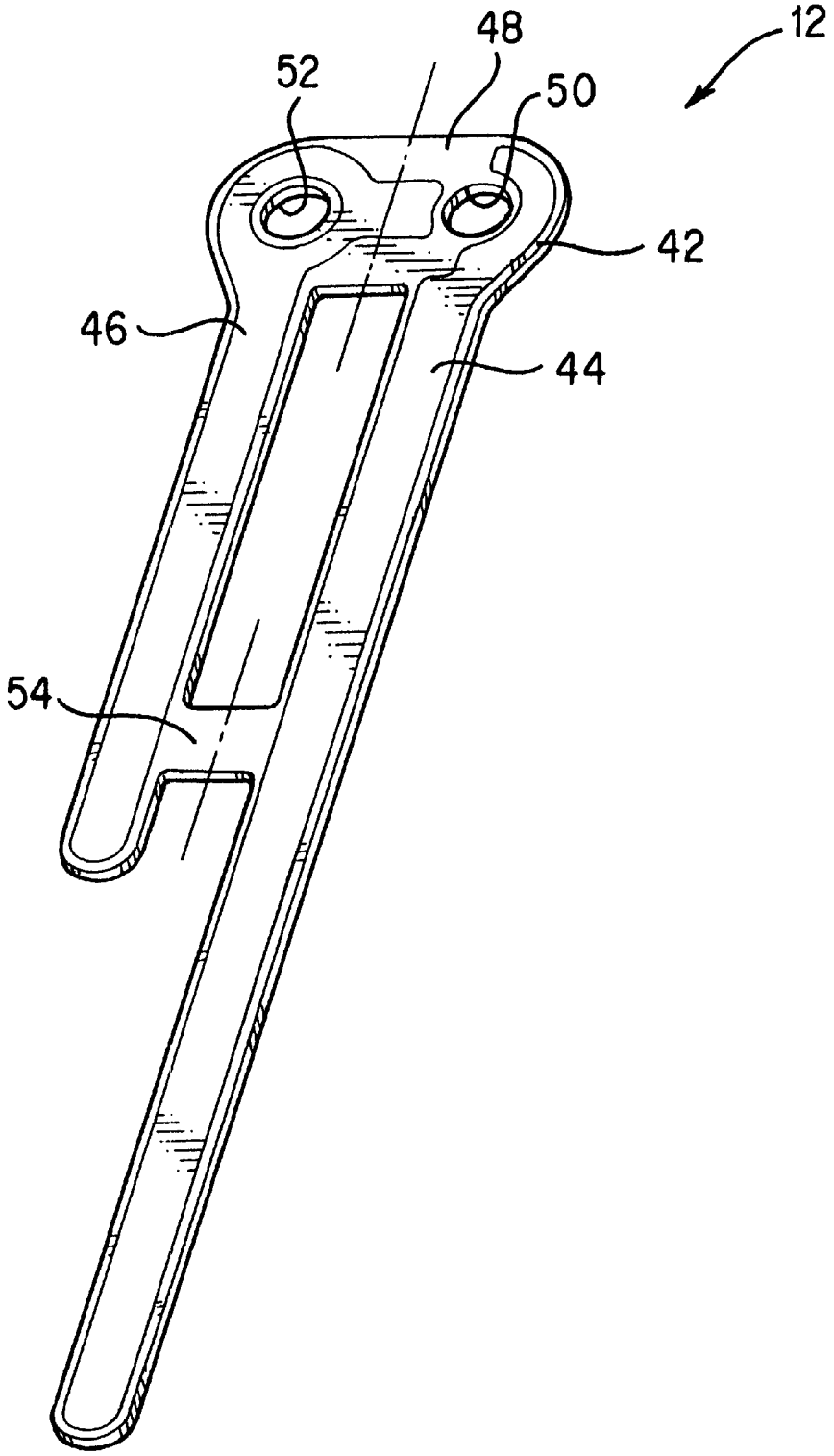
FIG. 3 is a top perspective view of an embodiment of the antenna assembly before folding.

Referring to FIGS. 3–8, details of antenna assembly 12 are shown. In FIG. 3 antenna assembly 12 is shown as including a substrate 42 that is made from a thin sheet of foldable insulative material, such as polypropylene or polyester. The substrate has opposed sides, and applied to one side are a pair of parallel conductive leads.

A first conductor or conductive lead 44 is applied as an elongated strip and functions as the hot lead. This is the driven side of antenna assembly 12. A second conductor or conductive lead 46 is applied as an elongated strip, shorter in length than lead 44, on the same side of substrate 42 and in parallel to lead 44. Lead 46 is the ground side of antenna assembly 12. Both leads 44 and 46 extend into a connector portion 48 of substrate 42 extending between the two sides of antenna assembly 12. In connector portion 48 are disposed fastening formations 50 and 52, in this case shown as apertures. Apertures 50 and 52 are symmetrically disposed about a center axis of substrate 42 so that when substrate 42 is folded along the shown phantom lines, apertures 50 and 52 are aligned. As seen in FIG. 3, both leads 44 and 46 have a portion extending on one side of connector portion 48, adjacent aperture 50. A cross bar 54 extends between the two leads 44 and 46 for purposes of alignment and assistance in accurately folding substrate 42 in half. However, cross bar 54 is optional and actually may preferably be eliminated for ease of manufacture. Both connector portion 48 and optional cross bar 54 may have score lines formed therein to assist in folding.

To construct antenna assembly 12, leads 44 and 46 are formed on one surface of substrate 42. Leads 44 and 46 may be copper foil laminated onto substrate 42. Alternatively, leads 44 and 46 may be etched onto a substrate 42, such as polyimide. Also, leads 44 and 46 may be screen-printed onto substrate 42. Other low cost simple application techniques may be employed as well. The conductive material used for the leads is not critical and may be any one of typically used conductive materials, such as copper or brass.

The size of antenna assembly 12, particularly the length of elongated leads 44 and 46, is generally governed by the particular electronic device in which the antenna assembly is employed. For example, when applied to a cordless telephone, the leads 44 and 46 should be configured to clear the housing wall to move the point of radiation outside of the main handset body. The important design parameters as seen from the description of the device herein include the difference in length between leads 44 and 46 and the width of the leads in combination with the substrate thickness.

After leads 44 and 46 are applied to substrate 42, substrate 42 can be die-cut around the leads to result in a thin assembly of parallel leads. Several methods of manufacturing the assembly are discussed below.

Figure 4:
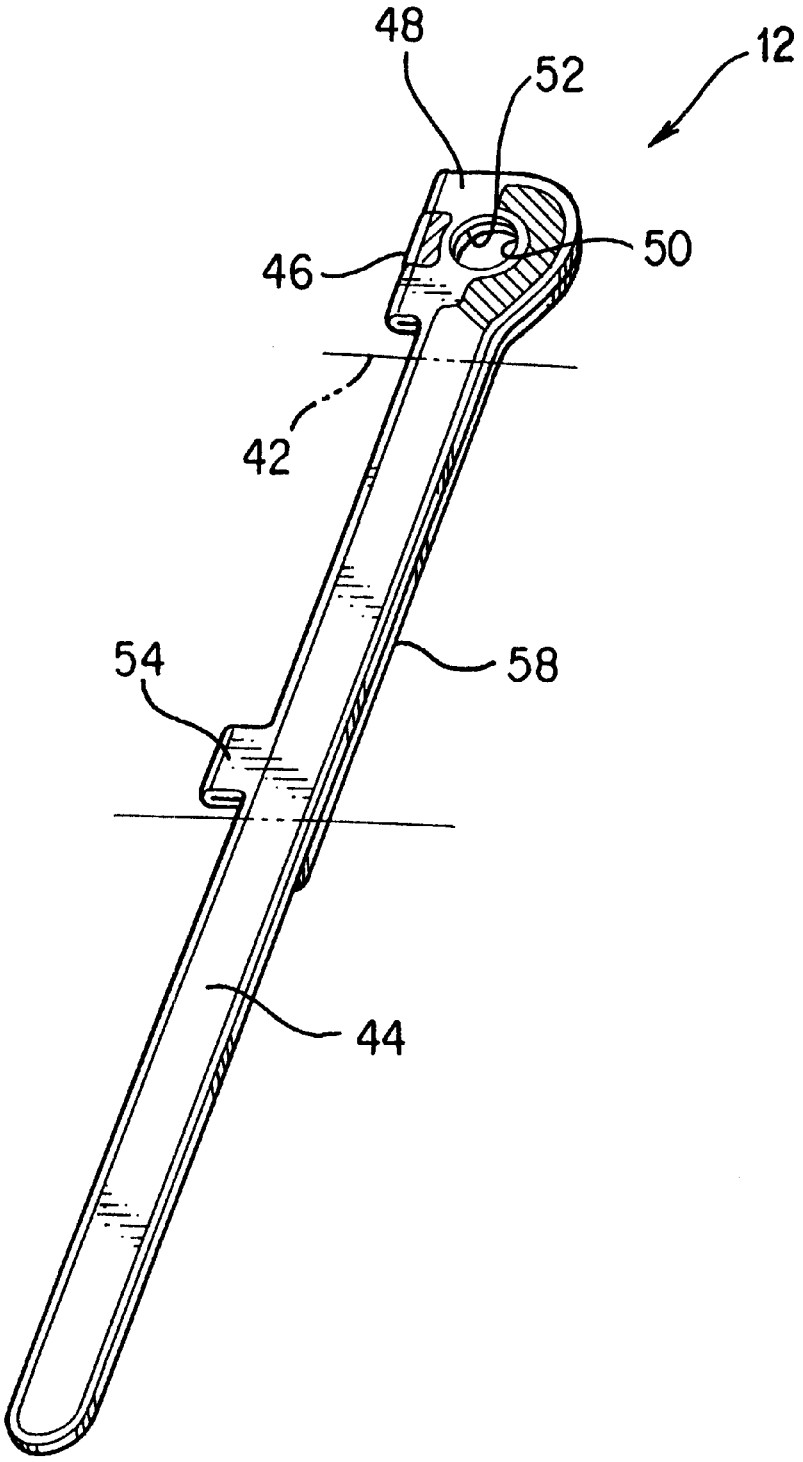
FIG. 4 is a top perspective view of the antenna assembly of FIG. 3 after folding showing the driven side of the conductor.
Figure 5:
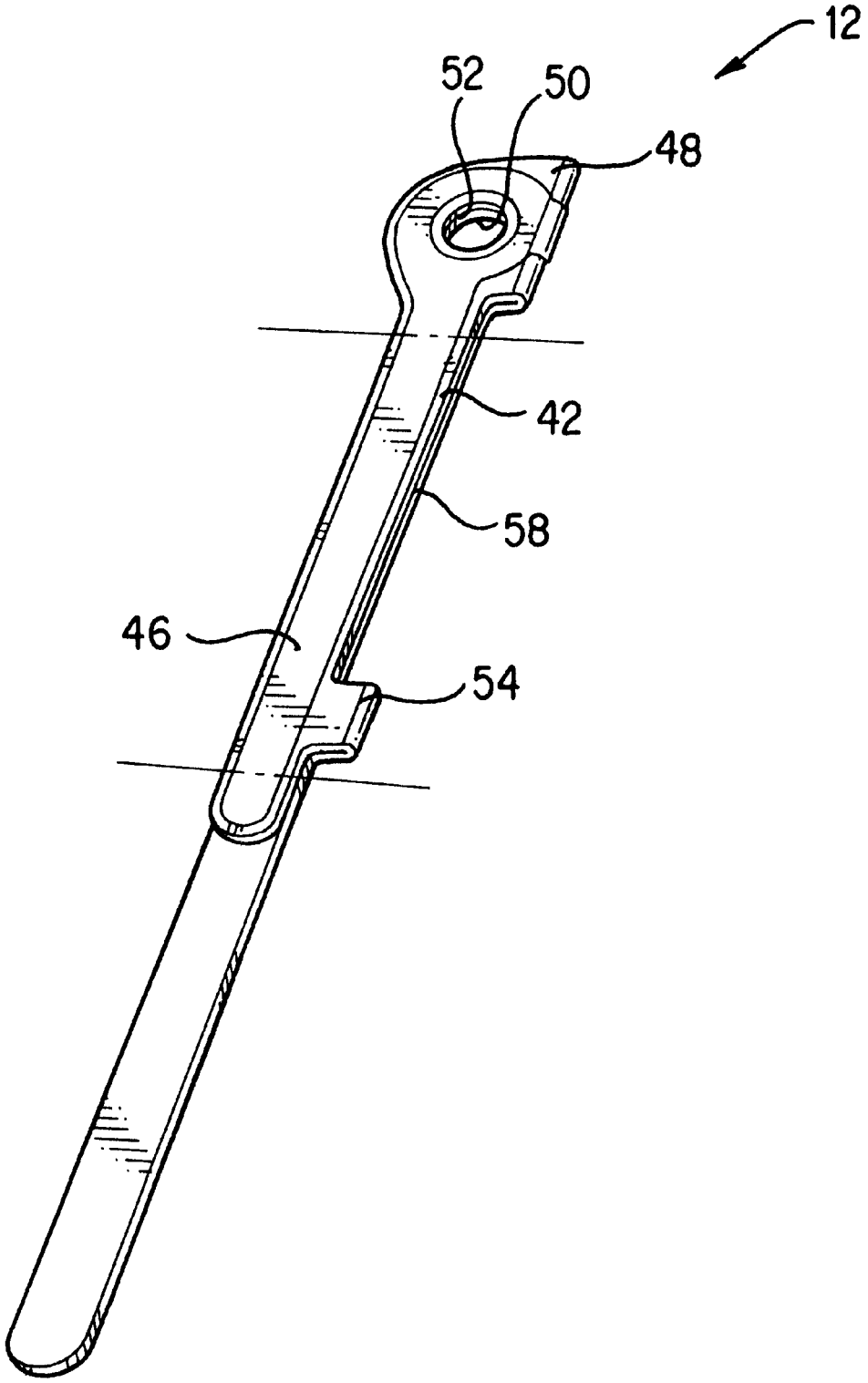
FIG. 5 is a bottom perspective view of the antenna assembly of FIG. 3 after folding showing the ground side of the conductor.

When leads 44 and 46 are formed on substrate 42 and substrate 42 is trimmed accordingly to form a base for leads 44 and 46, the assembly including substrate 42 and leads 44 and 46 is folded to overlap leads 44 and 46 in an aligned parallel relationship with substrate 42 disposed between. As seen in FIGS. 4 and 5, after folding, leads 44 and 46 are located on the outer side of the thin strip assembly. An adhesive 58 of any suitable type is disposed on the side of substrate 42 that the leads are not formed on to adhere the folded parts together. For example, a pressure sensitive adhesive can be applied to the other side of substrate 42 (not shown).

FIG. 4 shows the driven side of antenna assembly 12 with lead 44 thereon. Connector portion 48 shows areas of both leads 44 and 46 for contact with printed circuit board 14. The folded sides are secured together by adhesive 58 and apertures 50 and 52 are aligned. As seen in FIGS. 4 and 5, leads 44 and 46 are separated by twice the thickness of the substrate and the adhesive. The thickness of the substrate and adhesive are chosen along with the width of the leads to meet electrical design requirements.

FIG. 5 shows the other side of antenna assembly shown in FIG. 4 after folding. Lead 46 is exposed and extends with substrate 42 partially up substrate 42 beneath lead 44. Again,. adhesive 58 secures the folded sides together, and apertures 50 and 52 are aligned. Upon assembly to printed circuit board 14, the head of screw 16 directly abuts lead 46, which is the ground side, adjacent aperture 52 eliminating the need for an insulating washer.

Additional score lines may be provided as shown by the dashed lines in FIGS. 4 and 5 adjacent to connector portion 48 and the midpoint of lead 44 if bending will be required upon assembly to the electronic device. Of course, score lines may be provided at any desired location along the assembly. The leads will not crack as they are made of very thin malleable material such as copper foil.

Figure 6A:
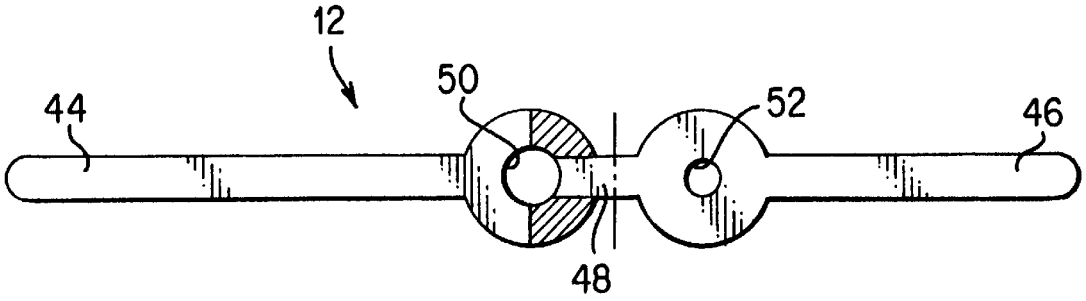
FIG. 6A is a schematic representation of a plan view of an alternative arrangement of antenna assembly prior to folding.
Figure 6B:
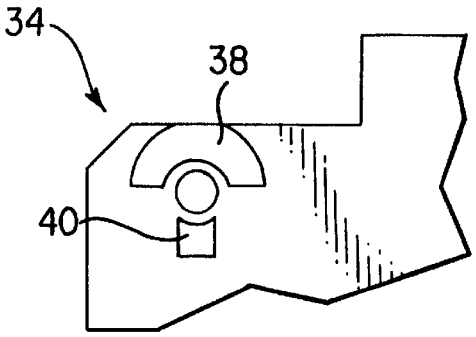
FIG. 6B is an enlarged partial plan view of a printed circuit board used in the antenna assembly shown in FIG. 6A.

FIGS. 3–5 show leads 44 and 46 disposed side by side prior to folding. However, leads 44 and 46 may be disposed in any relationship that facilitates folding to overlap the leads. FIG. 6 shows a preferred arrangement for purposes of manufacturing and die-cutting substrate 42. In FIG. 6A, which is a schematic representation of antenna assembly 12, leads 44 and 46 are disposed in parallel and coextensive but extending in opposite directions. Lead 46 extends across the fold line so that it makes contact to the ground lead 40 on the printed circuit board 14 as shown in FIG. 6B, after the antenna assembly is folded.

Figure 7:
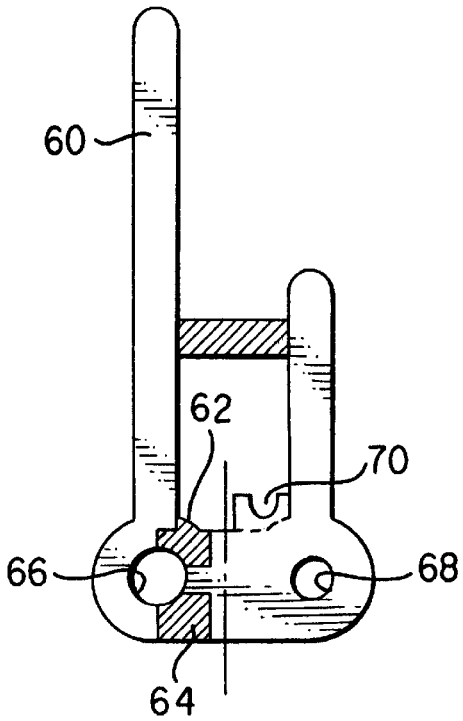
FIG. 7 is a schematic representation of antenna assembly with modified conductive leads.

FIG. 7 shows the conductive leads in a modified arrangement in which a conductive material 60 is allowed to extend to the edges of the substrate 42, except at relieved areas 62 and 64, to simplify manufacturing and relieved areas 62 and 64 are formed to delineate between conductors. Relieved areas 62 and 64 are formed in connector portion 48 such that when the assembly is folded and attached to printed circuit board 14, relieved areas 62 and 64 do not contact with printed circuit board 14 thus establishing two distinct points of contact for the driven conductor and the grounded conductor. Also, aperture 66 on the driven side is larger than aperture 68 on the grounded side. Thus, when the assembly is folded, apertures 66 and 68 align concentrically and provide automatic rlief for the driven side around screw 16.

Also shown in FIG. 7, is an anti-rotation device 70, which can be used with any of the embodiments. Anti-rotation device 70 is designed to provide an interference or interlocking formation that can engage with a protrusion on printed circuit board 14. This stabilizes antenna assembly 12 within electronic device 10.

Figure 8:
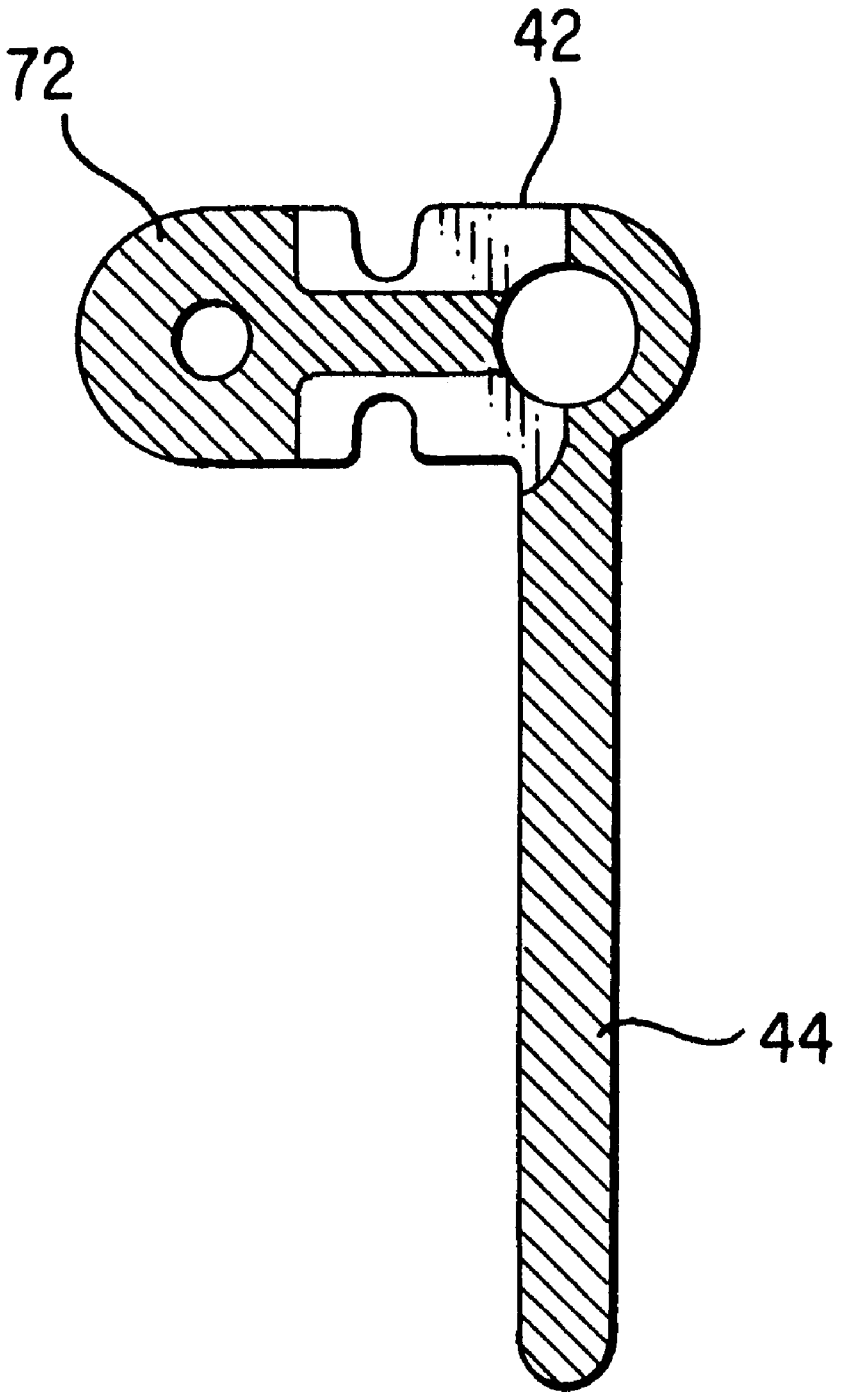
FIG. 8 is a plan view of another embodiment of the antenna assembly.

Another modification is shown in FIG. 8 in which it is shown that this invention can be used on antennas without an elongated ground lead. As seen in FIG. 8, a grounded conductor 72 is formed on one side of substrate 42 but does not extend in parallel to driven lead 44.

One method of die-cutting substrate 42 and leads 44 and 46 is shown in FIGS. 9A–9C. FIG. 9A shows the first die-cut in which a sheet of conductive foil 80, such as copper, is cut. After cutting, the foil 80 is laminated onto an insulator substrate 82. Special alignment is unnecessary, which greatly decreases the cost of manufacture. At this point, the substrate 82 may be a full sheet or strips. FIG. 9B shows the second die-cut in which the laminated substrate 82 is cut. The key to this technique is that the holes in the second cut connect all of the holes in the first cut all the way across the part. This separates the conductors to result in two separate conductors as shown in FIG. 9C. The above described method can be used for any of the embodiments described herein. It will be readily apparent to one of ordinary skill in this art that any number of die-cutting techniques may be used and that the configuration of the antenna assembly allows inexpensive manufacture.

While this invention is described in conjunction with the specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. An antenna assembly comprising:

a one-piece foldable insulator substrate that has a first face and a second face; and a first conductor and a second conductor formed on the first face of the insulator substrate, wherein upon assembly the first conductor and the second conductor are arranged to overlap each other with the insulator substrate therebetween and wherein) at least two portions of the second face are folded directly adjacent and contacting each other to form a thin flexible strip, wherein the first conductor and the second conductor are elongated strip is formed in parallel, and wherein the substrate includes a first elongated portion and a second portion, each portion supporting one of the first conductor and the second conductor, and a central connector portion extending between the first conductor and the second conductor and having a fastening formation therein.

2. The antenna assembly of claim 1, wherein the connector portion is folded in two parts upon assembly and one part includes a portion of each of the first conductor and the second conductor.

3. The antenna assembly of claim 1, wherein the fastening formation is a pair of apertures having different diameters that are overlapped and aligned when the substrate is folded for assembly.

4. The antenna assembly of claim 1, wherein the first conductor and second conductor are formed on the substrate in parallel and adjacent to each other extending in a same direction.

5. The antenna assembly of claim 1, wherein the substrate is a single sheet of insulative material folded in two pieces with each conductor formed on an outer surface of each folded piece.

6. The antenna assembly of claim 5, wherein the folded pieces of the substrate are secured together by adhesive.

7. The antenna assembly of claim 1, wherein the conductors are formed from a material selected from the group consisting of copper, copper foil, copper plating, and brass.

8. The antenna assembly of claim 1, wherein the substrate is formed from a material selected from the group consisting of polyester, polycarbonate, polypropylene and polyimide.

9. An antenna assembly comprising:

a one-piece foldable insulator substrate that has a first face and a second face;

a first conductor and a second conductor formed on the first face of the insulator substrate, wherein upon assembly the first conductor and the second conductor are arranged to overlap each other with the insulator substrate therebetween and wherein at least two portions of the second face are folded directly adjacent and contacting each other to form a thin flexible strip; and an anti-rotation device formed on the substrate.

10. An antenna assembly comprising:

a one-piece foldable insulator substrate that has a first face and a second face; and a first conductor and a second conductor formed on the first face of the insulator substrate, wherein upon assembly the first conductor and the second conductor are arranged to overlap each other with the insulator substrate therebetween and wherein at least two portions of the second face are folded directly adjacent and contacting each other to form a thin flexible strip).

wherein the first conductor and second conductor are formed on the substrate in parallel and extend in an opposite direction.

11. An electronic device comprising:

a housing;

a printed circuit board retained in the housing; and an antenna assembly extending from the housing and coupled to the printed circuit board, the antenna assembly including a unitary insulative substrate and a pair of conductive leads formed thereon disposed in an overlapping manner with the substrate therebetween, wherein the substrate and the pair of leads are fastened directly to the printed circuit board, wherein the substrate is a single sheet of die cut insulative material folded in two pieces, with each conductive lead formed on an other surface of each folded piece, and the folded pieces of the substrate are secured together by adhesive.

12. The electronic device of claim 11, wherein the conductive leads are elongated strips formed in parallel.

13. The electronic device of claim 11, further comprising a hollow cover that covers at least one of the conductive leads and is coupled to the housing, wherein the cover is not attached to the antenna assembly.

14. The electronic device of claim 13, wherein the cover is a resilient tubular sheath having an attachment end with an integral grommet that connects to the housing.

15. An electronic device comprising:

a housing;

a printed circuit board retained in the housing;

an antenna assembly extending from the housing and coupled to the printed circuit board, the antenna assembly including a unitary insulative substrate and a pair of conductive leads formed thereon disposed in an overlapping manner with the substrate therebetween, wherein the substrate and the pair of leads are fastened directly to the printed circuit board; and an anti-rotation device totaled on the substrate.

16. An electronic device comprising:

a housing;

a printed circuit board retained in the housing; and an antenna assembly extending from the housing and coupled to the printed circuit board, the antenna assembly including a unitary insulative substrate and a pair of conductive leads formed thereon disposed in an overlapping manner with the substrate therebetween, wherein the substrate and the pair of leads are fastened directly to the printed circuit board, wherein the printed circuit board has an attachment point thereon and the substrate has an aperture therein, and further comprising a fastener that connects the substrate to the printed circuit board by engaging the aperture and the attachment point and making contact between each of the conductive leads and the printed circuit board.

17. The electronic device of claim 16, wherein the attachment point of the printed circuit board is an aperture, and wherein the fastener engages the aperture of the printed circuit board and the aperture of the substrate.

* * * * *